US008062190B2

(12) United States Patent
Pyles et al.

(10) Patent No.: US 8,062,190 B2
(45) Date of Patent: Nov. 22, 2011

(54) STATIONARY EXERCISE BICYCLE

(75) Inventors: Nathan Pyles, Lake Mill, WI (US); Derek Nelson, Lake Mill, WI (US); Wang Yong Fa, Taichung Hsein (TW)

(73) Assignee: Johnson Health Tech Co., Ltd., Taya Hsiang, Taichung Hsien (TW)

( * ) Notice: Subject to any disclaimer, the term of this patent is extended or adjusted under 35 U.S.C. 154(b) by 1024 days.

(21) Appl. No.: 11/263,570

(22) Filed: Oct. 31, 2005

(65) Prior Publication Data

US 2007/0099766 A1 May 3, 2007

(51) Int. Cl.
*A63B 22/06* (2006.01)

(52) U.S. Cl. ..... 482/57; 482/51

(58) Field of Classification Search ..... 482/57, 482/58, 59, 60, 61, 62, 63, 64, 65, 51
See application file for complete search history.

(56) References Cited

U.S. PATENT DOCUMENTS

| | | | | |
|---|---|---|---|---|
| 4,148,478 | A * | 4/1979 | Moyski et al. | 482/63 |
| 5,090,770 | A * | 2/1992 | Heinrichs et al. | 297/344.19 |
| 5,167,597 | A * | 12/1992 | David | 482/68 |
| 5,531,503 | A | 7/1996 | Hughes | |
| 5,674,158 | A | 10/1997 | Navas | |
| 5,971,894 | A * | 10/1999 | Chen | 482/57 |
| 6,039,676 | A * | 3/2000 | Clive | 482/57 |
| D429,508 | S * | 8/2000 | Clive | D21/663 |
| 6,394,937 | B1 * | 5/2002 | Voris | 482/139 |
| 6,527,291 | B1 | 3/2003 | Hurtig | |
| 6,585,215 | B2 * | 7/2003 | Duncan | 248/407 |
| 6,592,510 | B1 * | 7/2003 | Plentev | 600/14 |
| 6,845,997 | B2 | 1/2005 | Chou | |
| 6,926,645 | B1 * | 8/2005 | Stearns et al. | 482/62 |
| 7,097,596 | B2 * | 8/2006 | Yang | 482/57 |
| 2003/0064863 | A1 * | 4/2003 | Chen | 482/51 |
| 2003/0166437 | A1 * | 9/2003 | Ho | 482/63 |
| 2003/0199363 | A1 * | 10/2003 | Chen | 482/4 |
| 2004/0198561 | A1 | 10/2004 | Corbalis et al. | |
| 2005/0001404 | A1 * | 1/2005 | Mihelic | 280/278 |
| 2005/0088029 | A1 * | 4/2005 | Stokes | 297/461 |
| 2005/0227823 | A1 * | 10/2005 | Liao | 482/57 |
| 2006/0122039 | A1 * | 6/2006 | Lee et al. | 482/57 |

OTHER PUBLICATIONS

The International Preliminary Report on Patentability for PCT/US2006/039995 dated May 15, 2008.
Recumbent Bicycle—Illustrated in the attached Figs. 1-3 and described in the attachment entitled "Statements of Relevance", admitted prior art.
Upright Bicycle—Illustrated in the attached Fig. 4 and described in the attachment entitled "Statements of Relevance", admitted prior art.

* cited by examiner

*Primary Examiner* — Stephen Crow
*Assistant Examiner* — Tam Nguyen
(74) *Attorney, Agent, or Firm* — Michael Best & Friedrich LLP

(57) ABSTRACT

A stationary exercise bicycle including a base frame, a seat supporting assembly, a seat assembly being movably mounted on the seat supporting assembly to be guided along a path inclined at a selected angle related to the ground surface. The stationary exercise bicycle further comprises an assistance member attached to the seat assembly for providing an elevation force for a seat position adjustment. The present invention provides a stationary exercise bicycle with a benefit of quick, easy and convenient seat position adjustment, a benefit of grabbing a heart rate grip or touching a control console comfortably, a benefit of reducing abdomen compression of a user, and a benefit of an elevation force for assisting a seat position adjustment.

15 Claims, 6 Drawing Sheets

STATIONARY EXERCISE BICYCLE

FIELD OF THE INVENTION

This invention relates to a stationary exercise bicycle, more particularly to a stationary exercise bicycle which has several ergonomic benefits.

BACKGROUND OF THE INVENTION

Indoor exercise is getting more and more popular during recent decades. One of the popular indoor exercise apparatuses is the stationary exercise bicycle. Currently, there are generally two categories of popular stationary exercise bicycles on the market, the upright and recumbent bicycles.

FIG. 1 shows a recumbent bicycle 10. The recumbent bicycle 10 comprises a seat back 11 and a seat 12 which has a geometry center 13A. The seat 12, usually mounted on a framework 16, is movable on a track 14 inclined at an angle of about seven degrees. The recumbent bicycle 10 has a pair of crank arms 18 and pedals 19. Both the crank arms 18 and pedals 19 are rotated about a crank axis. A handle 17 is attached to the recumbent bicycle 10 for grabbing while a user needs to push the pedals 19 in a condition of operating a high level resistance. Sometimes, the handle 17 may further comprise a heart rate grip for monitoring the heart rate condition of a user.

One drawback of the recumbent bicycle 10 is that a user's knee may interfere with the handle 17 when a user wants to comfortably lean on the seat back 11 and properly grab the handle 17 at the same time. If a user would like to avoid the problem of interference between the handle 17 and the user's knee, the user can move the seat 12 backward to a proper position which means the user can properly extend the legs during one portion of an exercise cycle. In other words, the user can properly extend the legs during a downward and backward cycle of the pedals 19. In the condition of properly extending the user's legs, the interference problem is avoided but another problem is created. The user can not grab the handle 17 properly as shown in FIG. 2. One way to solve the problem is that the user needs to bend forward at the waist in order to grab the handle 17. After a long operation of the recumbent bicycle 10, the back muscles of the user would suffer an uncomfortable stress because of the bending forward posture.

FIG. 3 shows a user moving the seat 12 forward in order to grab the handle 17 properly. In this condition, the user needs to give up the benefit of properly extending the legs. Another disadvantage of the recumbent bicycle 10 is that a vertical height 105 between the geometry center 13A and the crank axis is much less than the user's knee height. The user's knee and thigh may be elevated too much and the user's thigh may compress the user's abdomen, especially for some people who have an obesity problem.

FIG. 4 shows an upright bicycle 20. The upright bicycle 20 comprises a seat 22 which has a geometry center 23A. The seat 22, usually mounted on a framework 26, is movable on a seat support 24. The framework 26 is inclined at an angle of about seventy-three degrees. The upright bicycle 20 has a pair of crank arms 28 and pedals 29. Both the crank arms 28 and pedals 29 are rotated around a crank axis. A handle 27 is attached to the upright bicycle 20 for grabbing. In a general operating posture, a user needs to bend forward at the waist and the user's back and arms are burdened accordingly. For the foregoing reasons, there is a need for a stationary exercise bicycle to provide several ergonomic benefits which can make a user comfortably and easily operate the stationary exercise bicycle.

SUMMARY OF THE INVENTION

In a preferred embodiment of the present invention, the stationary exercise bicycle comprises a base frame resting on a ground surface, a seat supporting assembly mounted on a rear frame for supporting a seat assembly. The seat assembly is movably mounted on the seat supporting assembly and the seat assembly can be guided by the seat supporting assembly along a path inclined at a selected angle relative to the ground surface. The stationary exercise bicycle further comprises at least an information receiving member mounted on the front portion of the base frame for a user to input operating information or workout parameters, a pair of pedals positioned on the front portion of the base frame, and an assistance member attached to the seat assembly for providing an elevation force for a seat position adjustment.

Several objects and advantages of the present invention are: (a) to provide a stationary exercise bicycle with several ergonomic benefits; (b) to provide a stationary exercise bicycle with a benefit of quick, easy and convenient seat position adjustment; (c) to provide a stationary exercise bicycle with a proper seat position to fully exercise leg muscles of a user; (d) to provide a stationary exercise bicycle with a benefit of grabbing a heart rate grip or touching a control console comfortably without applying excess stress to the lower back muscles ; (e) to provide a stationary exercise bicycle with benefit of reducing abdominal compression of a user; (f) to provide a stationary exercise bicycle with a benefit of balanced muscle training of the hamstrings and quadriceps of a user; (g) to provide a stationary exercise bicycle with an elevation force for assisting a seat position adjustment.

The reader is advised that this summary is not meant to be exhaustive. Further features, aspects, and advantages of the present invention will become better understood with reference to the following description, accompanying drawings and appended claims.

BRIEF DESCRIPTION OF THE DRAWINGS

For a better understanding of the present invention, reference may be made to the accompanying drawings, in which.

DETAILED DESCRIPTION

Figure 1:
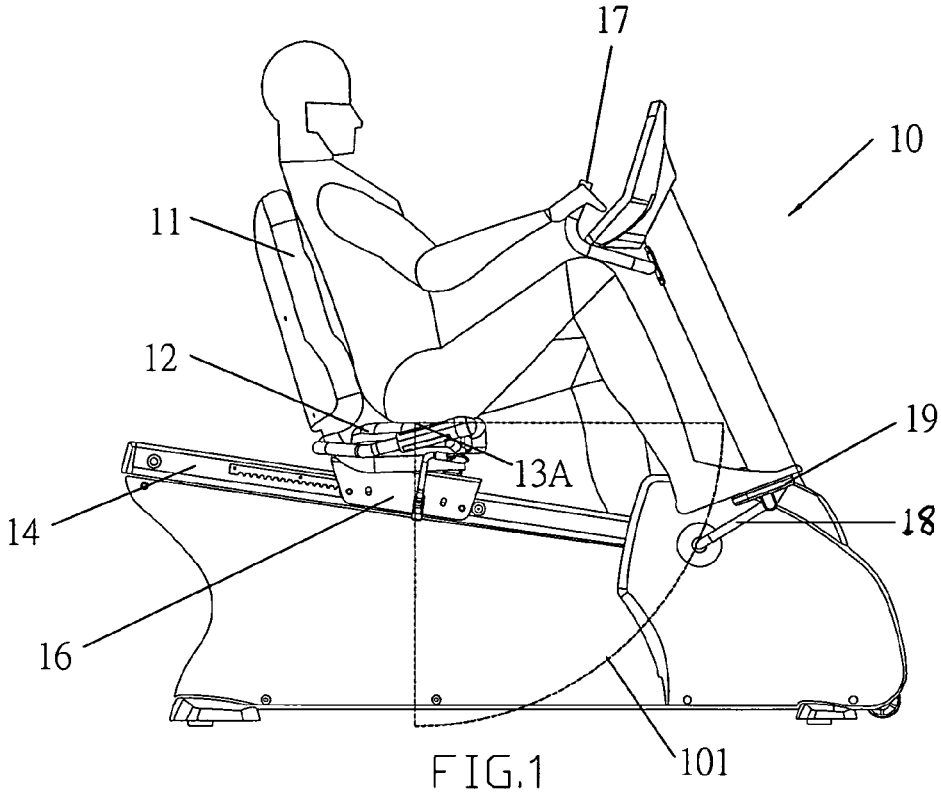
FIG.1 Prior Art
FIG. 1 is a side view of a recumbent bicycle in the prior art.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Figure 5:
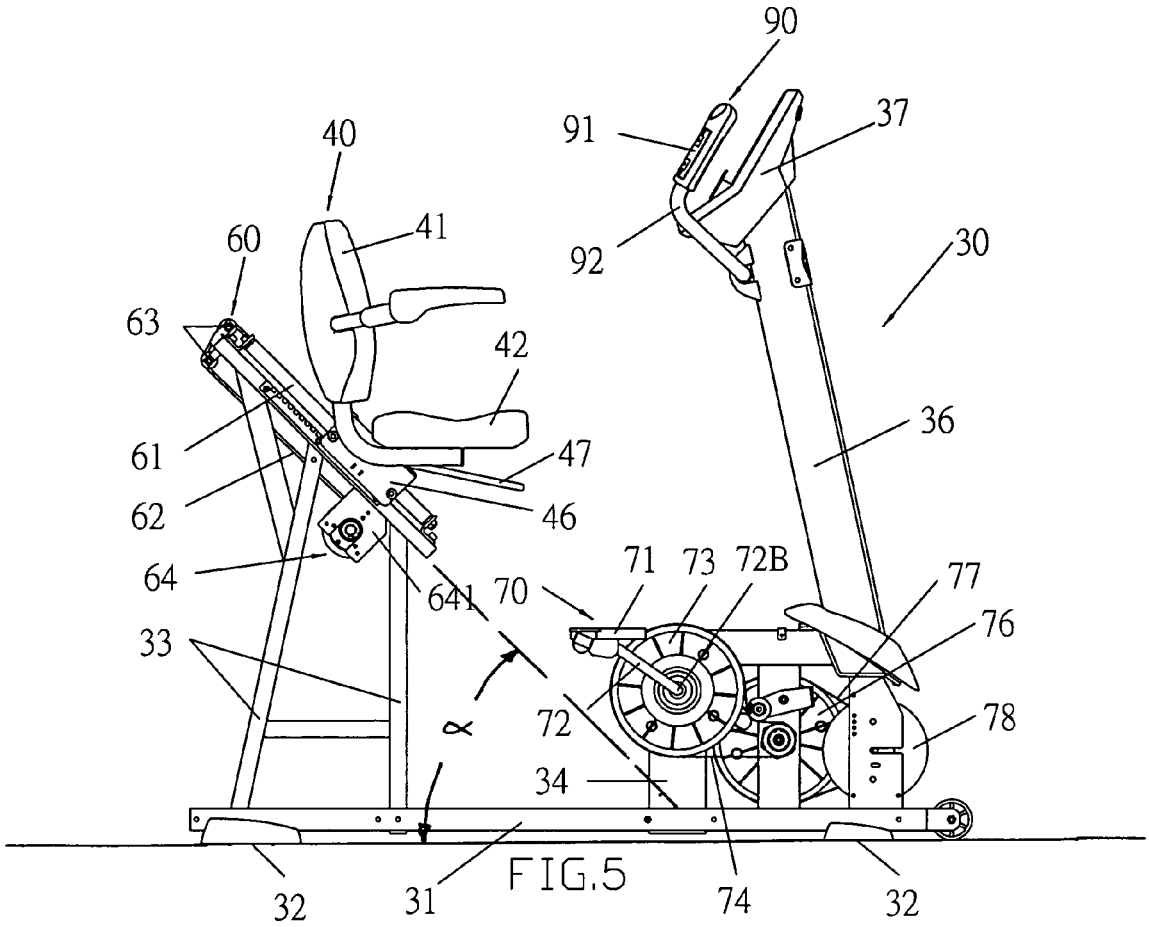
FIG. 5 is a side view of an exercise bicycle according to a preferred embodiment of the present invention showing detail structures.
Figure 6:
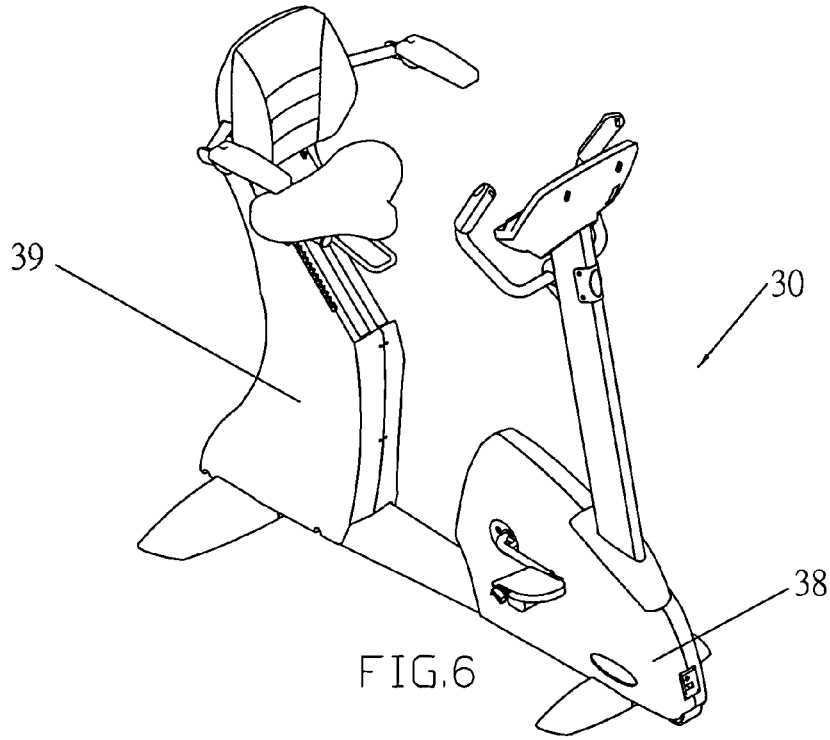
FIG. 6 is a perspective view of the exercise bicycle of FIG. 5 with shrouds.

Now referring to FIGS. 5 and 6, a stationary exercise bicycle 30 is illustrated therein. FIG. 5 shows the stationary exercise bicycle 30 without first and second shrouds 38, 39 shown in FIG. 6. The stationary exercise bicycle 30 comprises a base frame 31 resting on a ground surface, a front frame 34 extending upwardly from the front portion of the base frame 31, and a rear frame 33 extending upwardly from the rear portion of the base frame 31. There is also some optional legs 32 extending laterally from the base frame 31. Usually, the function of the legs 32 is to enhance the stability of the stationary exercise bicycle 30 while allowing a user some lateral movement during an operation. The stationary exercise bicycle 30 further comprises a seat supporting assembly 60 mounted on the rear frame 33 for supporting a seat assembly 40. The seat assembly 40 is movably mounted on the seat supporting assembly 60. In the preferred embodiment, the seat assembly 40 can be guided by the seat supporting assembly 60 along a path inclined at an angle of substantially forty-five degrees relative to the ground surface. Therefore, the stationary exercise bicycle 30 achieves benefits of enhanced ergonomics in several aspects.

Now referring to FIG. 5 in more detail, the stationary exercise bicycle 30 further comprises a resistance assembly 70 mounted on the front portion of the base frame 31. The resistance assembly 70 comprises a pair of crank arms 72 mounted on the front frame 34 defining an axis 72B. The pair of crank arms 72 can be rotated around the axis 72B. There are first and second pedals 71, 71B (shown in FIG. 9) respectively coupled to the pair of crank arms 72. Usually, the first and second pedals 71, 71B are respectively attached to ends of the pair of crank arms 72 so that the first and second pedals 71, 71B are rotated about the axis 72B and along an arcuate path when the pair of crank arms 72 rotate about the axis 72B. In other embodiments of the present invention, the arcuate path could be a closed path with a different shape. For example, a substantial ellipse could be an option of the closed path. In general, the arcuate or closed path of the present invention defines a boundary around an area that can be divided into four sectors. For example, the first pedal 71 shown in FIG. 5 is currently located at the periphery of the upward and forward sector of the arcuate or closed path. The resistance assembly 70 further comprises a first pulley 73 coupled to the axis 72B for simultaneous rotation with the crank arms 72, a second pulley 76 mounted on the front portion of the base frame 31, a first belt 74 connecting the first pulley 73 and the second pulley 76, a resistance member 78 mounted on the front portion of the base frame 31, and a second belt 77 connecting the second pulley 76 and the resistance member 78. Usually, the resistance member 78 could be an eddy current brake, a generator or a friction brake.

While a user cycling the first and second pedals 71, 71B along the arcuate path, the pair of crank arms 72 and the first pulley 73 are rotated about the axis 72B. Then, the first pulley 73 drives the second pulley 76 via the first belt 74 and the second pulley 76 drives the resistance member 78 via the second belt 77. The resistance level of the resistance member 78 usually is adjustable. Because of the connection of each component of the resistance assembly 70, the resistance of the resistance member 78 may be transmitted to a user via the first and second pedals 71, 71B. While operating the resistance assembly 70, the position of the axis 72B has an important effect to the ergonomic posture and movement of a user's legs. A proper position of the axis 72B can create several ergonomic benefits such as balanced muscle training or reducing interference problems.

The stationary exercise bicycle 30 in FIG. 5 comprises an upward mast 36 mounted on the front portion of the base frame 31. The upward mast 36 has an upper portion and lower portion wherein the lower portion could be attached to the base frame 31 by welding or using some bolts for assembling. The stationary exercise bicycle 30 further comprises a control console 37 mounted on the upper portion of the upward mast 36. One purpose of the control console 37 is to receive some operating information from a user such as a resistance level or operating time which a user desires. The stationary exercise bicycle 30 may also optionally includes a handle assembly 90 mounted on the upper portion of the upward mast 36. The handle assembly 90 has a handle 92 connected to the upper portion of the upward mast 36 and a heart rate grip 91 attached to one end of the handle 92.

The handle assembly 90 can perform several functions. One of them is that the heart rate grip 91 of the handle assembly 90 can receive the heart rate information of a user. The heart rate information of a user is one kind of operating information which may be incorporated into some exercise programs. In some embodiments, the handle assembly 90 may have some control buttons such as resistance level control buttons. That means a user can grab on the handle assembly 90 and input resistance level information simultaneously. Another function of the handle assembly 90 is that a user can grab on the handle assembly 90 to push the first and second pedals 71, 71B in a high level resistance condition. The reason is that a user needs to incorporate leg muscles, abdomen, back and arms in order to overcome the high level resistance of the resistance assembly 70. Without grabbing on the handle assembly 90 or the handle 92, a user only can utilize muscles of legs to overcome the high level resistance. Therefore, a user's legs may fatigue quickly in the high level resistance condition. For people skilled in the art, it is easy to understand that the control console 37, heart rate grip 91 or resistance level control buttons on the handle assembly 90 are possible information receiving members for a user to input operating information of the stationary exercise bicycle 30.

Now referring to FIG. 5 again, the seat supporting assembly 60 comprises a track 61 mounted on the rear portion of the base frame 31 via the rear frame 33. It is understood by people skilled in the art that the illustrated track 61 is only one kind of seat support to support the seat assembly 40. Other embodiments of the seat support, such as a convention four-bar linkage mechanism, are within the scope of the present invention. In the preferred embodiment, the track 61 is inclined at an angle $\propto$ of substantially 45 degrees relative to the ground surface. The track 61 can guide the seat assembly 40 moving along a path while a user adjusts the assembly 40 from its lowest position toward its highest position along the track 61. In the preferred embodiment, the path of the seat assembly 40 is substantially linear constituted by the low and high ends of the track 61. Because the track 61 is inclined at an angle $\propto$ of substantially 45 degrees relative to the ground surface, the path of the seat assembly 40 is also substantially 45 degrees relative to the ground surface.

The seat supporting assembly 60 further comprises a spring assembly 64 attached to the rear portion of the base frame 31. In the preferred embodiment, the spring assembly 64 is mounted on the rear frame 33. The spring assembly 64 is also coupled to the seat assembly 40 via a connecting member 62 and optional direction pulleys 63. In operation, the spring assembly 64 can store energy when the seat assembly 40 is adjusted from the highest position to the lowest position along the track 61. When a user wants to adjust the seat assembly 40 from the lowest position toward the highest position, the stored energy in the spring assembly 64 could be released and provide an elevating force to assist a user to adjust the seat assembly 40 along the track 61 from the lowest position toward the highest position. Because the track 61 is inclined at an angle ∝ of substantially 45 degrees, the heavy weight of the seat assembly 40 may cause some problem while a user adjusts the seat assembly 40 from the lowest position toward the highest position. The stored energy in the spring assembly 64 may assist to overcome the heavy weight of the seat assembly 40 while moving the seat assembly 40 from the lowest position toward the highest position.

Figure 8:
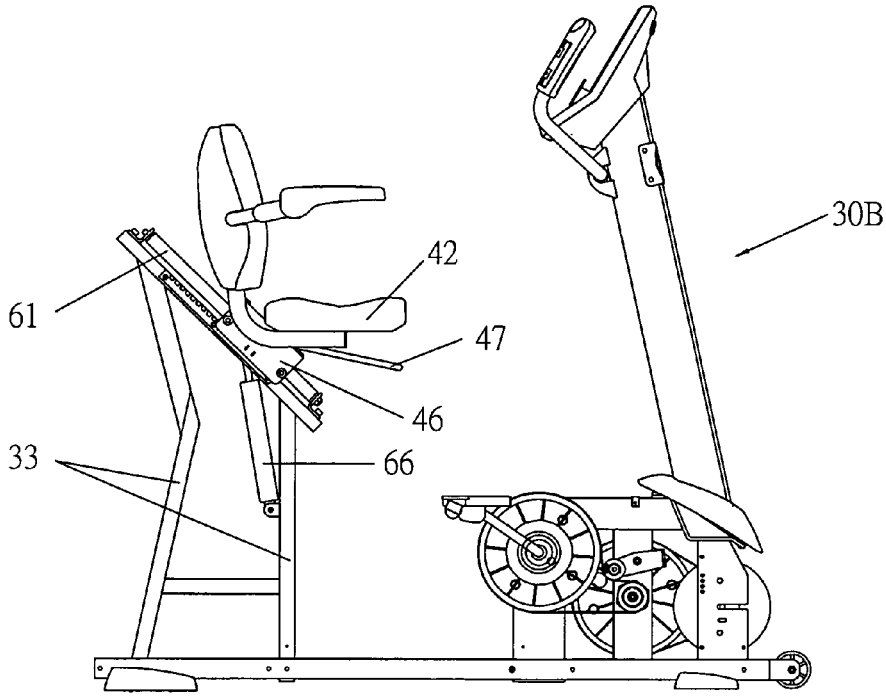
FIG. 8 is a side view of an exercise bicycle according to another embodiment of the present invention having a cylinder to replace the spring assembly.

FIG. 8 shows another embodiment of the present invention. A stationary exercise bicycle 30B is illustrated. The main difference between the stationary exercise bicycles 30 and 30B is that the spring assembly 64 in the stationary exercise bicycle 30 is replaced by a cylinder 66 in the stationary exercise bicycle 30B. One end of the cylinder 66 is connected the rear frame 33 and the other end of the cylinder 66 is coupled to the seat assembly 40. The function of the cylinder 66 is similar to the spring assembly 64 shown in FIG. 5. They both provide an elevating force to assist a user adjusting the seat assembly 40 along the track 61 from the lowest position toward the highest position. It is understood by people skilled in the art that the cylinder 66 may further comprise a resilient member inside the cylinder 66 in order to store energy. The resilient member could be gas, linear spring, rubber and its equivalents.

Figure 7:
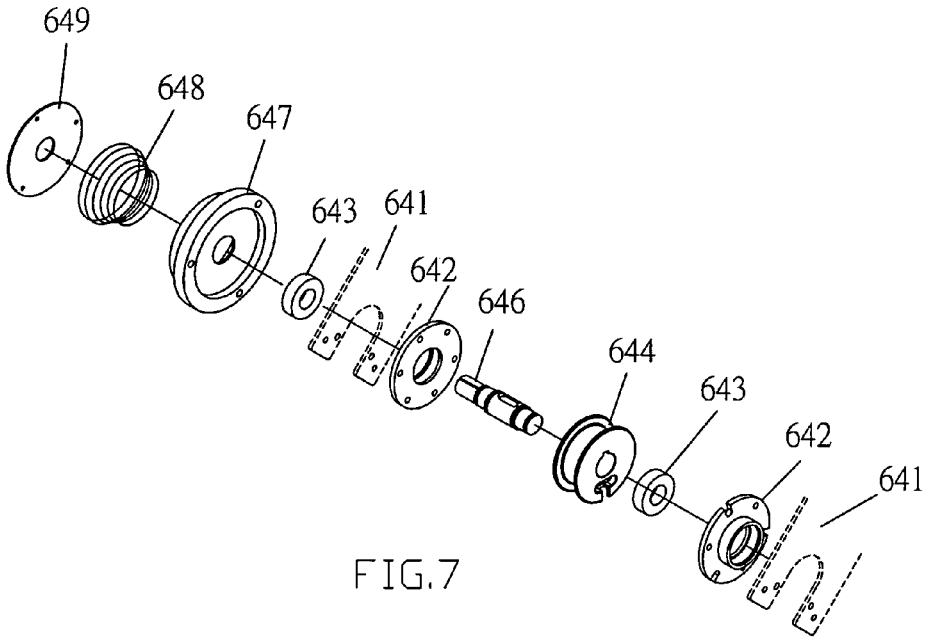
FIG. 7 is a exploded perspective view of a spring assembly of the exercise bicycle of FIG. 5.

Now referring to FIG. 7, an exploded view of the spring assembly 64 is disclosed. Housings 642 are respectively mounted on brackets 641. Bearings 643 are also respectively mounted in the housings 642. An axle 646 is coupled to a reel 644 to rotate simultaneously. The axle 646 is supported by the bearings 643. A spring housing 647 is mounted on one of the brackets 641 and a spring 648 is positioned in the spring housing 647. A cover 649 is coupled to the spring housing 647 to enclose the spring 648 therein. It should be noticed that one end of the spring 648 is fixed on the spring housing 647 and the other end of the spring 648 is attached to the axle 646. Since the reel 644 for receiving the connecting member 62 may be rotated simultaneously with the axle 646, the spring 648 could be actuated to store and release spring energy while the reel 644 is rotated. That is, the spring 648 could store or release spring energy when a user adjusts the seat assembly 40 between the highest and lowest positions. In some simplified embodiments, other assistance member may be directly attached to the seat assembly 40 and the rear portion of the frame 31. For example, a linear spring or a resilient rope could be attached between the seat assembly 40 and the rear portion of the base frame 31 to provide an elevation force to the seat assembly 40.

Now still referring to FIG. 5, the seat assembly 40 comprises a seat 42 which is movably mounted on the track 61 and is movable along the path of the track 61 from the lowest position to the highest position. In the preferred embodiment, the path of the seat 42 is substantially linear constituted by the low and high ends of the track 61. Because the track 61 is inclined at an angle ∝ of substantially 45 degrees relative to the ground surface, the path of the seat 42 is also substantially 45 degrees relative to the ground surface. The seat 42 may further have a framework 46 which is slidably mounted on the track 61. The seat assembly 40 further comprises a position handle 47 pivotally mounted on the framework 46 in order to lock or actuate the seat 42 to a user-desired position. The seat assembly 40 may optionally have a seat back 41 connected to the seat 42. The seat back 41 is in an orientation substantially perpendicular to the ground surface. In the preferred embodiment, the top surface of the seat 42 is substantially parallel to the ground surface.

Figure 2:
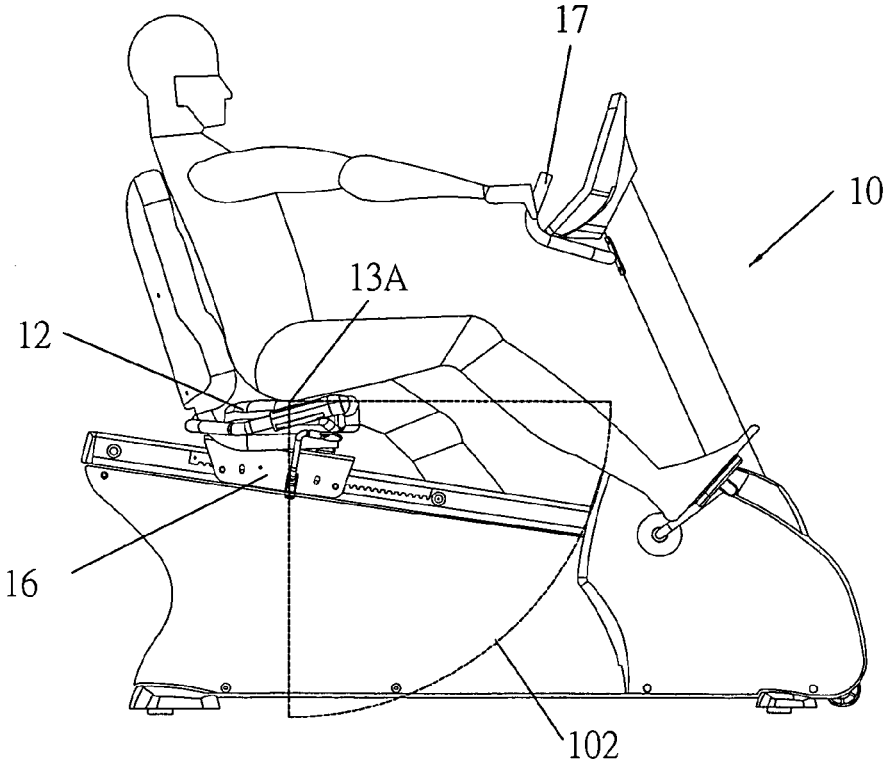
FIG.2 Prior Art
FIG. 2 is a side view of the recumbent bicycle of FIG. 1 with a different seat position.
Figure 3:
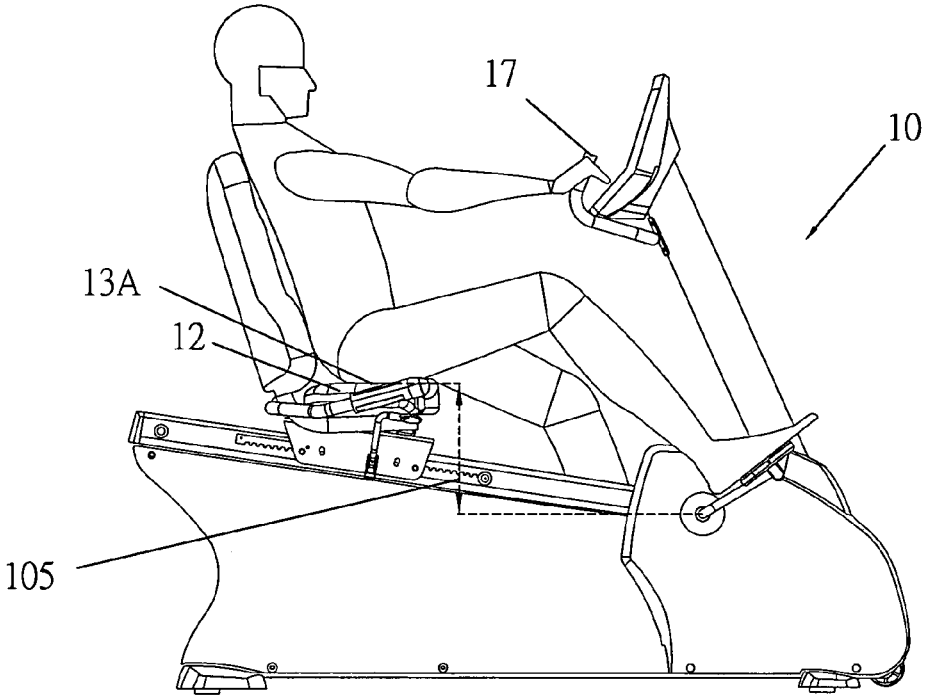
FIG.3 Prior Art
FIG. 3 is a side view of the recumbent bicycle of FIG. 1 showing some ergonomic relationship.
Figure 4:
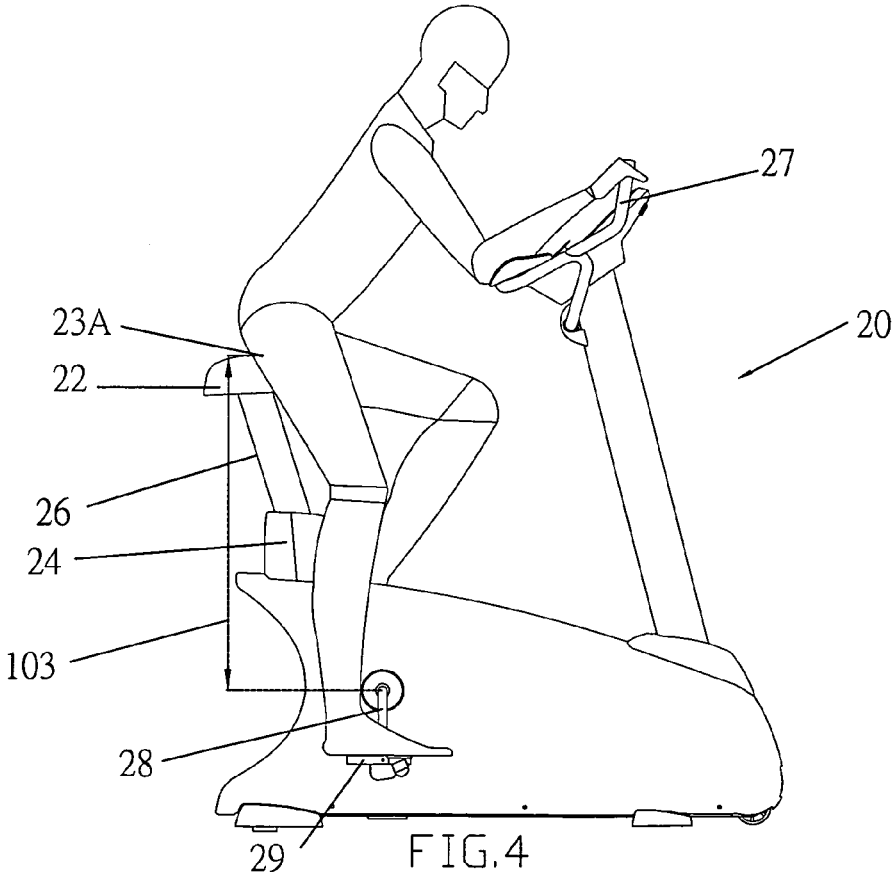
FIG.4 Prior Art
FIG. 4 is a side view of an upright bicycle in the prior art.
Figure 11:
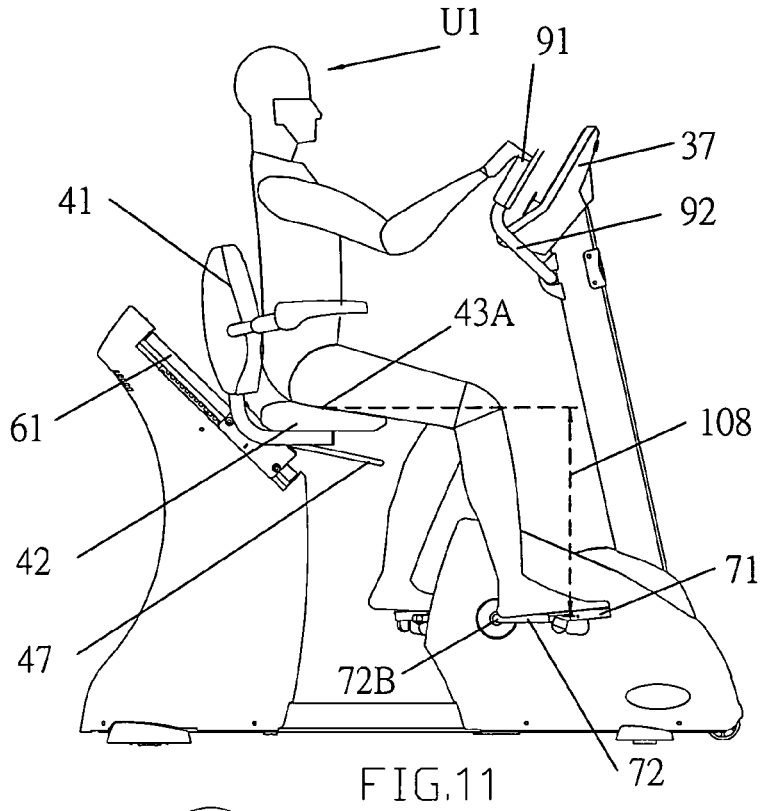
FIG. 11 is a side view of the exercise bicycle of FIG. 5 showing a cycling condition of the first user.
Figure 12:
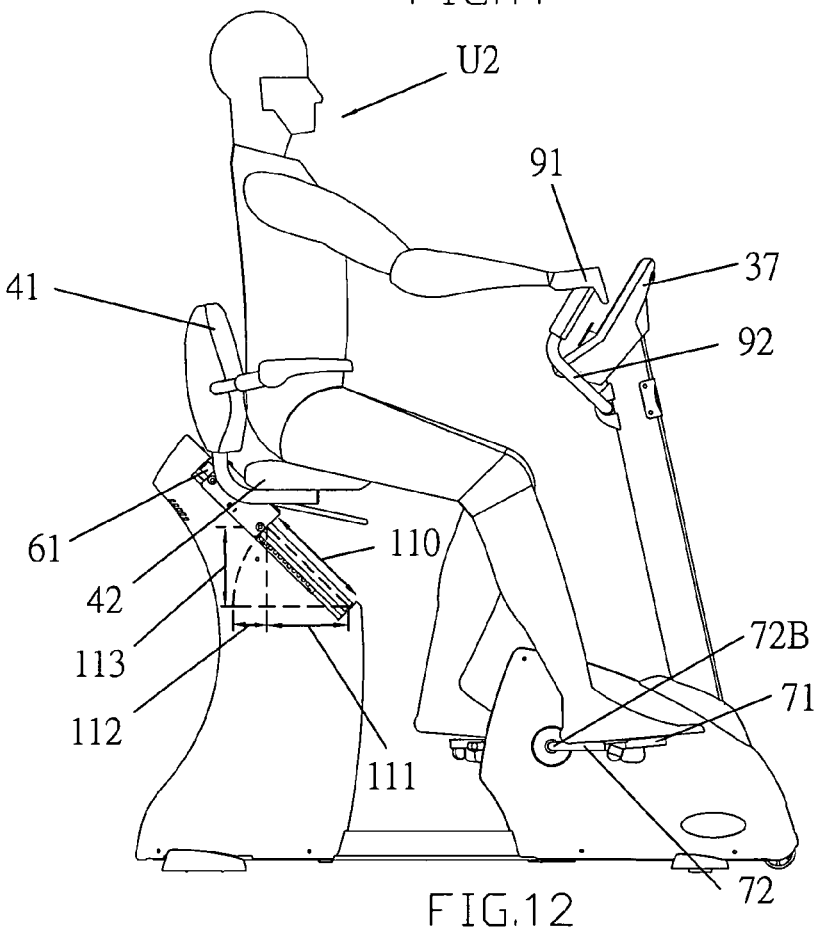
FIG. 12 is a side view of the exercise bicycle of FIG. 5 showing a cycling condition of the second user.

Because of the orientations of the seat 42 and the seat back 41, a user can operate the stationary exercise bicycle 30 in a comfortable posture. That is, a user can comfortably maintain the waist in a neutral position as shown in FIGS. 11 or 12. There are two benefits of this neutral position of the waist. One of them is that a user does not need to bend forward or backward at the waist so that the back muscles may not be in a stressed condition during a long term operation. The other benefit is that a user does not need to bend the torso or head forward such as shown in FIGS. 1 and 2 in order to monitor or operate some workout parameters. In other words, the neck muscles of a user could also be in a neutral position because of the orientations of the seat 42 and the seat back 41. Because the upper portion of the upward mast 36 is spaced from the seat 42, the handle assembly 90 and the control console 37 are also spaced from the seat 42. In the preferred embodiment, the handle assembly 90 or the control console 37 is directly above the axis 72B and in an upward projected scope of the radius of the pair of crank arms 72. Because the handle assembly 90 or the control console 37 is selectively spaced from the seat 42 and the track 61 is also selectively inclined at an angle relative the ground surface, users as shown in FIGS. 11 and 12 can both comfortably reach the handle assembly 90 and the control console 37.

Figure 9:
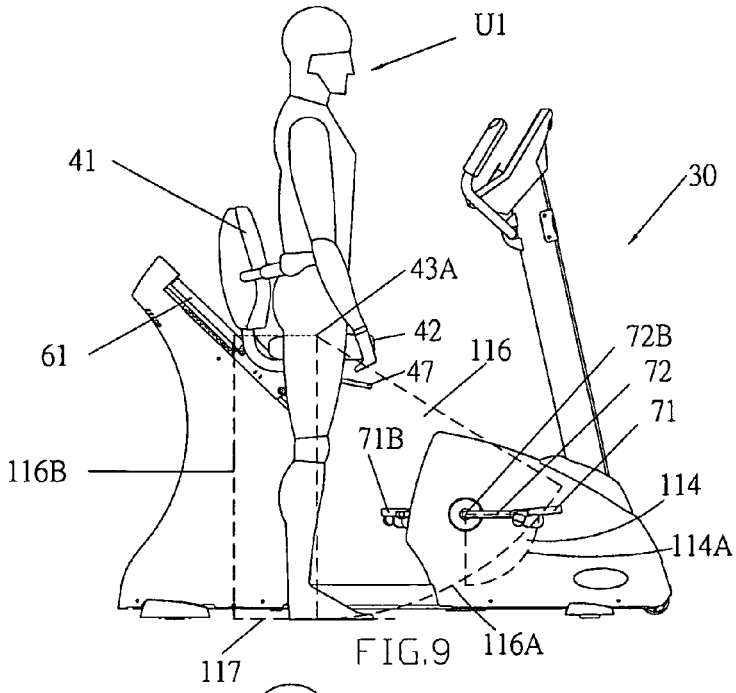
FIG. 9 is a side view of the exercise bicycle of FIG. 5 showing some ergonomic position of a first user.
Figure 10:
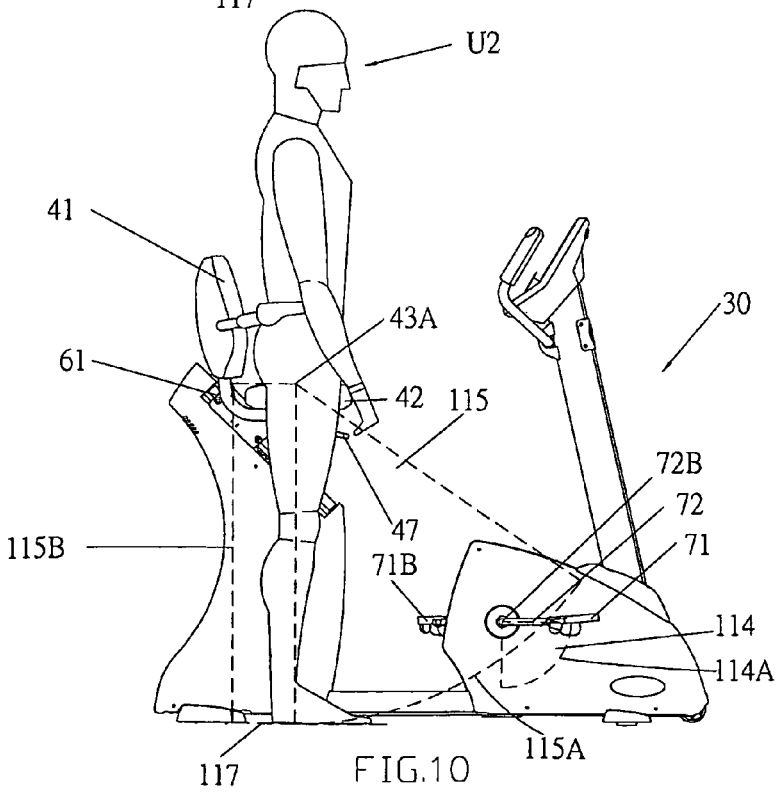
FIG. 10 is a side view of the exercise bicycle of FIG. 5 showing some ergonomic position of a second user.

Now referring to FIGS. 9 and 10, one of the ergonomic benefits of the stationary exercise bicycle 30 is illustrated in more detail. A first user U1 proper for the lowest position of the seat 42 is shown in FIG. 9. The first user U1 represents the shortest people who can operate the stationary exercise bicycle 30 properly. The industry usually may take some statistic stature for design reference. For example, the average stature of the bottom five percentage female aged from 18 to 79 years old is about 59 inches. The 59 inches could be the low-limit design reference of the first user U1. A second user U2 proper for the highest position of the seat 42 is shown in FIG. 10. The design reference of stature of the second user U2 is about 74 inches which is the average stature of the 95 percentage male aged from 18 to 79 years old.

Now referring to FIG. 9, there is a reference plane 117 for the first user U1 to step on. In the preferred embodiment of the present invention, the reference plane 117 could be the ground surface. In some other embodiments, the reference plane 117 could be a user foot platform which is higher than the ground surface. The seat 42 further comprises a geometry center 43A and a first vertical height 116B constituted by the vertical distance between the geometry center 43A and the reference plane 117. The geometry center 43A is defined as the center of the top surface of the seat 42. A first reference sector 116 is defined by the geometry center 43A and the first vertical height 116B, where a line equal in length to the first vertical height 116B is dropped down from the geometry center 43A, and where the line is swept forward through an angle (e.g. 60 degrees) about the geometry center 43A to form the first reference sector 116. The geometry center 43A is the center of the first reference sector 116 and the first vertical height 116B is the radius of the first reference sector 116. Because the arcuate path of the first and second pedals 71, 71B may be divided into four segments, one of the segments is shown in FIG. 9, a downward and backward segment 114A. As shown in FIG. 9, the first pedal 71 is in a condition of beginning to move along the downward and backward segment 114A. During moving along the downward and backward segment 114A, the first pedal 71 is moved substantially along the periphery 116A of the first reference sector 116. The moving mode of the first pedal 71 along the periphery 116A of the first reference sector 116 creates a benefit of quick, easy and convenient position adjustment of the seat 42. The proper position of the seat 42 for the first user U1 can be achieved quickly and easily by the present invention.

As shown in FIG. 9, each crank arm 72 is rotated about an axis 72B so that the respective pedal 71, 71B defines an area or sector 114 when the respective pedal 71, 71B is rotated along the downward and backward segment 114A of its closed path. The periphery 116A of the first reference sector 116 (i.e., the radially-outermost line defined by the reference sector 116) intersects the sector 114 defined by the crank arms 72.

In adjusting a proper seat position of the recumbent bicycle 10 and upright bicycle 20, a user usually does not understand how to easily and quickly adjust the best seat position for exercise. Both of the recumbent bicycle 10 and upright bicycle 20 require trial and error methods to get the correct seat position. If a seat is not in a proper position, the legs of a user may not be extended properly and the leg muscles may not be fully exercised. Also, an incorrect seat position may cause pain and stress of a user's knee or lower back after a long term operation of stationary exercise bicycles. As shown in FIG. 9, the present invention shows a way of quick, easy and convenient position adjustment of the seat 42. First, the first user U1 directly straddles in front of the seat 42 in a leg extending condition and has the feet of the first user U1 spaced apart the width of the shoulders. Second, the first user U1 adjusts the seat 42 to make the buttock or pubic bones of the first user U1 engaged with the top surface of the seat 42 and the bottom surfaces of the feet of the first user U1 engaged with the reference plane 117. Then, latch the position handle 47 into a new position.

The seat 42 is currently in the proper position for the first user U1 to sit. Also, the seat 42 is currently in the proper position for cycling wherein the first user U1 may have a slight bend in his/her knee during at least a portion of the downward and backward segment 114A when the first user U1 puts his/her feet on the first and second pedals 71, 71B, and with his/her back in contact with the seat back 41. The first vertical height 116B or the radius of the first reference sector 116 can substantially represent the length of the legs of the first user U1 in a proper leg extending condition. Because the first and second pedals 71, 71B are moved substantially along the periphery 116A of the first reference sector 116 during the downward and backward segment 114A, the legs of the first user U1 could be properly extended during at least one portion of the downward and backward segment 114A. That is, the first user U1 can extend the legs properly and exercise the leg muscles fully after the quick, easy and convenient position adjustment of the seat 42 without suffering any pain of his/her knee or low back. Inversely, if the seat 42 is positioned too low, there is extra stress on the knee and knee pain is common. If the seat 42 is positioned too high, the first user U1 must over reach with each push of the legs and this causes a twisting in the lower back and lower back pain. Optimum seat setting is important for long term, pain free operation of stationary exercise bicycles.

FIG. 10 shows the quick, easy and convenient position adjustment of the seat 42 for the second user U2. The operation of adjusting the seat 42 is the same as the first user U1 shown in FIG. 9. The seat 42 may create a horizontal distance 111 and a vertical distance 113 as shown in FIG. 12 when the seat 42 is moved from the lowest position to the highest position. In the preferred embodiment, the track 61 is inclined at an angle of substantially 45 degrees relative to the ground surface so that the horizontal distance 111 and the vertical distance 113 may be substantially equal. The horizontal distance 111 moves the seat 42 backward from the axis 72B but the vertical distance 113 increases the height between the reference plane 117 and the geometry center 43A. That is, a second vertical height 115B is longer than the first vertical height 116B by the vertical distance 113. A second reference sector 115 is defined by the geometry center 43A and the second vertical height 115B, where a line equal in length to the second vertical height 115B is dropped down from the geometry center 43A, and where the line is swept forward through an angle (e.g. 60 degrees) about the geometry center 43A to form the second reference sector 115. The first and second pedals 71, 71B are still moved substantially along the periphery of the second reference sector 115 during the downward and backward segment 114A, the legs of the second user U2 could be properly extended during one portion of the downward and backward segment 114A. That is, the second user U2 can also extend the legs properly and exercise the leg muscles fully after the quick, easy and convenient position adjustment of the seat 42.

As shown in FIG. 10, each crank arm 72 is rotated about an axis 72B so that the respective pedal 71, 71B defines an area or sector 114 as the respective pedal 71, 71B is rotated along the downward and backward segment 114A of its closed path. The periphery 115A of the second reference sector 115 (i.e., the radially-outermost line defined by the reference sector) 115 intersects the sector 114 defined by the crank arms 72.

Now referring to FIGS. 9 and 10 again, the first and second pedals 71, 71B are moved substantially along the peripheries 116A, 115A of respective the first and second reference sectors 116, 115 during the downward and backward segment 114A. More specifically, at least one portion of the first and second pedals 71, 71B are moved outside the peripheries 116A, 115A of the respective first and second reference sectors 116, 115 during at least one portion of the downward and backward segment 114A. Because the axis 72B is within the first and second reference sectors 116, 115 and at least one portion of the first and second pedals 71, 71B are moved outside the periphery 116A, 115A of both the first and second reference sectors 116, 115 during the downward and backward segment 114A, both the first and second user U1, U2 can extend the legs properly and exercise the leg muscles fully after the quick, easy and convenient position adjustment of the seat 42.

Now referring to FIGS. 11 and 12, another ergonomic benefit of the stationary exercise bicycle 30 is illustrated. FIG. 11 shows the first user U1 in the lowest position operating the stationary exercise bicycle 30. The first user U1 can grab the heart rate grip 91 or touch the control console 37 easily without bending forward at the waist. Because the first user U1 does not bend forward or backward at the waist, both the torso and head of the first user U1 could be maintained in an upright position. That means both back and neck muscles of the first user U1 are under their neutral position. The first user U1 can grab the heart rate grip 91 or touch the control console 37 comfortably without being under some muscle stressed condition. FIG. 12 shows the second user U2 in the highest position operating the stationary exercise bicycle 30. Because the track 61 is inclined at a selected angle, the seat 42 does not move as far in the backward direction as the recumbent bicycle 10. The second user U2 can also grab the heart rate grip 91 or touch the control console 37 comfortably without some muscle being stressed. Some description of the benefits of the selected angle of the track 60 is presented below.

As shown in FIG. 12, detailed relationship between the horizontal distance 111 and the vertical distance 113 is illustrated. When the seat 42 is moved from the lowest position to the highest position along the track 61, a linear distance 110 of the seat 42 is created. The horizontal distance 111 is the horizontal project distance of the linear distance 110 and the vertical distance 113 is the vertical project distance of the linear distance 110. In the preferred embodiment, the track 61 is inclined at an angle of substantially 45 degrees relative to the ground surface so that the horizontal distance 111 is substantially equal to the vertical distance 113. The selected incline angle of the track 61 also creates a reduced distance 112 and the magnitude of the reduced distance 112 is the difference between the linear distance 110 and the horizontal distance 111. In the recumbent bicycle 10, the track 14 is inclined at an angle of about 7 degrees relative to the ground surface. When a higher user moves the seat 12 backward, the recumbent bicycle 10 can only produce a minimal reduced distance because of the minimal inclined angle of the track 14. That is, the seat 12 could be moved backward too much so that a taller user cannot grab the handle 17 properly while operating the recumbent bicycle 10 as shown in FIG. 2.

The reduced distance 112 of the present invention as shown in FIG. 12 is apparent because of the selected angle of the track 61. The seat 42 may not move backward as much as the recumbent bicycle 10 so that both the first user U1 proper for the lowest position and the second user U2 proper for the highest position can comfortably grab the heart rate grip 91 or touch the control console 37 without leaning forward at their waists. This ergonomic benefit of the present invention solves the long existing problem of the recumbent bicycle 10. A taller user of the recumbent bicycle 10 needs to bend forward at his/her waist frequently when the taller user grabs the handle 17 or operates some workout parameters such as the resistance level. The vertical distance 113 is also apparent because of the selected angle of the track 61. The vertical height 113 compensates the second vertical height 115B when the seat 42 is in the highest position. Because the second vertical height 115B is compensated, the scope of the second reference sector 115 is enlarged. That is, the first and second pedals 71, 71B are still moved substantially along the periphery 115A of the second reference sector 115 during the downward and backward segment 114A. The quick, easy and convenient position adjustment of the seat 42 of the present invention will be applicable for both the first user U1 proper for the lowest position and the second user U2 proper for the highest position.

Because of the relationship between the pedal 19, the handle 17 and the seat 12, the recumbent bicycle 10 has some long existing shortages to be improved. First, the knee of a user would be elevated too high so that there may be a problem of interference between the knee of the user and the handle 17 as shown in FIG. 1. Second, because the knee of the user is elevated too high, the thigh of the user may be too close to the abdomen and create compression to the abdomen of the user, especially for some users with an obesity problem. Another shortfall of both the recumbent bicycle 10 and the upright bicycle 20 is an unbalanced muscle training of the hamstrings and quadriceps of users. A user of the recumbent bicycle 10 may exercise the hamstrings too much because the knee of the user is elevated too high and the thigh of the user moves above the hip joint of the user during most time of cycling the recumbent bicycle 10. A user of the upright bicycle 20 may exercise the quadriceps too much because the thigh of the user moves below the hip joint of the user during most time of cycling the upright bicycle 10.

Now referring to FIG. 11, a third vertical height 108 of the preferred embodiment is illustrated. The third vertical height 108 is a vertical distance defined by the axis 72B and the geometry center 43A. The third vertical height 108 is substantially equal to the knee height of the user U1 when the seat 42 is positioned in the lowest position. The knee height of a user is defined as a vertical height between the knee and the bottom of the foot of the user. More specifically, the knee height of the user U1 is about 18 inches because the average knee height of the bottom five percentage female aged from 18 to 79 years old is about 18 inches. When the seat 42 is moved to the highest position as showed in FIG. 12, the third vertical height 108 is increased by the vertical distance 113 because of the selected inclined angle of the track 61. The third vertical height 108 is also substantially equal to the knee height of the second user U2 when the seat 42 is positioned in the highest position. More specifically, the knee height of the second user U2 is about 24 inches because the average knee height of the 95 percentage male aged from 18 to 79 years old is about 24 inches. It is still under scope of the present invention if the track 61 is elongated or shortened so that the lowest and highest positions of the seat 42 could be varied. There is a middle position of the seat 42 between the lowest and highest position and third vertical height 108 of the middle position of the seat 42 is between 18 and 24 inches.

Several ergonomic benefits are created when the third vertical height 108 of the stationary exercise bicycle 30 is substantially equal to the knee height of a user during operating. As shown in FIG. 11, the right knee of the first user U1 is substantially at the height of the geometry center 43A when the first pedal 71 is in a condition of beginning the downward and backward segment 114A (shown in FIG. 9). That is, the knees of the first user U1 may not be elevated above the geometry center 43A too much during the upward segments of the arcuate path of the first and second pedals 71, 71B and the knees of the first user U1 are moved around the height of the geometry center 43A during the arcuate path. One of the ergonomic benefits is that the knees of the first user U1 may not interfere with the handle 92 because the knees are not elevated too much. Another benefit is that the abdomen of the first user U1 would not be compressed because the thigh is not moved toward the abdomen too much. Another ergonomic benefit of the third vertical height 108 of the present invention is about balanced muscle training. During at least one portion of the upward segments of the arcuate path, the knees of the first user U1 would be above the height of the geometry center 43A. Inversely, the knees of the first user U1 would be below the height of the geometry center 43A during at least one portion of the downward segments of the arcuate path. Because the knees of the first user U1 are moved around the height of the geometry center 43A during the arcuate path of the first and second pedals 71, 71B, the training of the hamstrings and quadriceps of the first user U1 could be balanced.

Because the track 61 of the stationary exercise bicycle 30 is inclined at a selected angle, the third vertical height 108 is also substantially equal to the knee height of the second user U2 when the seat 42 is positioned in the highest position. That means the knees of the second user U2 are also moved around the height of the geometry center 43A and the knees are not elevated too much so that the second user U2 can also enjoy the ergonomic benefits of the third vertical height 108 of the present invention.

In the preferred embodiment as shown in FIG. 12, the track 61 is inclined at an angle of substantially 45 degrees relative to the ground surface so that both the reduced distance 112 and the vertical distance 113 are apparent because of the selected angle of the track 61. As mentioned above, the apparent reduced and vertical distances 112, 113 can create several ergonomic benefits. Different selected angles can create the ergonomic benefits if the selected angles can create apparent reduced and vertical distances. The relationship between the selected angles, reduced distances, and vertical distances is as below:

| Selected Angle | Reduced Distance Rate | Vertical Distance Rate |
|---|---|---|
| 30 | 0.13 (1/8) | 0.5 (1/2) |
| 35 | 0.18 (1/6) | 0.57 (5/9) |
| 40 | 0.23 (2/9) | 0.64 (5/8) |
| 45 | 0.29 (1/3) | 0.71 (2/3) |
| 50 | 0.36 (3/8) | 0.77 (7/9) |
| 55 | 0.43 (4/9) | 0.82 (5/6) |
| 60 | 0.5 (1/2) | 0.87 (7/8) |

Selected angles in the above chart represent angles between the track 61 and the ground surface for different alternative embodiments. The reduced distance rates mean reduced distances divided by respective linear distances. A higher reduced distance rate means its corresponding reduced distance is more apparent. For example, in the preferred embodiment, the selected angle is 45 degrees and the reduced distance rate is 0.29, about two-thirds. The linear distance 110 of the preferred embodiment is 250 mm so that the reduced distance 112 is about 73 mm. The apparent reduced distance is sufficient to achieve the ergonomic benefit aforementioned. In an alternative embodiment, the selected angle is 30 degree and the reduced distance rate is 0.13, about eighth. The vertical distance rates in the third column of the chart mean vertical distances divided by respective linear distances. The data of the third column is presented in the same way of the reduced distance rates of the second column.

Although the chart only identifies angles that vary between about 30 and about 60 degrees, the angle in other embodiments can be about 35 and about 55 degrees, or even between about 40 and about 50 degrees. In the illustrated embodiment, the angle is about 45 degrees.

Now referring to FIGS. 9-12 for the general operation of the stationary exercise bicycle 30 of the present invention. First, a user directly straddles in front of the seat 42 and has the feet spaced apart the width of the shoulders. Second, the user adjusts the seat 42 to make the buttock or pubic bones of the user engaged with the top surface of the seat 42 with the bottom surfaces of the feet of the user completely engaged with the reference plane 117. Then, latch the position handle 47 into a new position. The seat 42 is currently in a proper position for the user to sit. Also, the seat 42 is currently in the proper position for cycling. Now, the user sits on the top surface of the seat 42 and has the back contacting the seat back 41. The user puts the feet respectively on the first and second pedals 71, 71B and begins cycling. The user inputs some operating information such as resistance or operating time to the stationary exercise bicycle 30 via the control console 37. Then, the user can grab on the handle assembly 90 for monitoring the heart rate or providing a support when the user needs to pull the handle assembly 90 in a condition of operating a high level resistance.

The previously described embodiments of the present invention have many advantages, including: (a) to provide the stationary exercise bicycle 30 with a benefit of quick, easy and convenient seat position adjustment; (b) to provide the stationary exercise bicycle 30 with a proper seat position to fully exercise leg muscles of a user; (c) to provide the stationary exercise bicycle 30 with a benefit of grabbing the heart rate grip 91 or touching the control console 37 comfortably without having back muscles under some stressed condition; (d) to provide the stationary exercise bicycle 30 with a benefit of reducing abdominal compression of a user; (e) to provide the stationary exercise bicycle 30 with a benefit of balanced muscle training of the hamstrings and quadriceps of a user; (f) to provide the stationary exercise bicycle 30 with the elevation force for assisting the seat position adjustment.

The present invention does not require that all the advantageous features and all the advantages need to be incorporated into every embodiment thereof. Although the present invention has been described in considerable detail with reference to certain preferred embodiment thereof, other embodiments are possible. For example, the apparatus of the present invention may comprise a conventional four-bar linkage mechanism to be a seat support and the alternative seat support may still be under the scope of the present invention. Therefore, the spirit and scope of the appended claims should not be limited to the description of the preferred embodiment contained herein.

What is claimed is:

1. A stationary exercise bicycle comprising:

a base frame including a front portion and a rear portion, the base frame adapted to rest on a surface defining a reference plane;

a front frame extending upwardly from the front portion of the base frame;

a resistance assembly mounted on the front frame;

a rear frame extending upwardly from the rear portion of the base frame at a distance from the front frame such that there is an open space between the front frame and the rear frame, the open space configured to allow a user to step through the open space between the front frame and the rear frame;

a seat support assembly mounted on the rear frame, the seat support assembly including, a track inclined at a permanently fixed angle wherein the angle is between about forty degrees and about sixty degrees relative to the surface, and a seat coupled to the track and being moveable along the track from a lowest position to a highest position, the seat having a top surface and a geometry center coincident with the top surface that defines a vertical height between the geometry center and the reference plane, wherein positions of the geometry center and the reference plane define a first line that is swept forward approximately 60 degrees about the geometry center to define a first reference sector rotated about the geometry center;

first and second pedals coupled to the base frame for rotation about an axis and adapted to be propelled by the user's feet, the first and second pedals rotating along a closed circular path defining four equal length sectors, wherein one of the four equal length sectors is a downward and backward sector, wherein a periphery of the first reference sector intersects the downward and backward sector for every position of the seat along the track;

a mast extending upwardly from the front frame, the mast including a lower portion and an upper portion;

a control console mounted on the upper portion of the mast; and a handle assembly mounted on the upper portion of the mast.

2. The stationary exercise bicycle of claim 1, wherein the handle assembly is directly above the closed circular path.

3. The stationary exercise bicycle of claim 2, wherein at least a portion of the control console is directly above the closed circular path.

4. The stationary exercise bicycle of claim 1, wherein a line that extends through the geometric center at the fixed angle of the track relative to the surface intersects the closed circular path.

5. The stationary exercise bicycle of claim 1, wherein the fixed angle is forty-five degrees.

6. The stationary exercise bicycle of claim 1, wherein the fixed angle is between about forty degrees and about fifty degrees.

7. The stationary exercise bicycle of claim 1, wherein the seat further includes a rear portion and a front portion, wherein the rear portion is wider than the front portion to support the user, and wherein the front portion is narrower than the rear portion to allow the user's thighs to move downward below the top surface of the seat.

8. The stationary exercise bicycle of claim 1, further comprising a spring assembly configured to assist the seat in movement from the lowest position to the highest position.

9. A stationary exercise bicycle comprising:

a base frame including a front portion and a rear portion, the base frame adapted to rest on a surface defining a reference plane;

a front frame extending upwardly from the front portion of the base frame;

a resistance assembly mounted on the front frame and including a first shroud;

a rear frame extending upwardly from the rear portion of the base frame at a distance from the front frame such that there is an open space between the front frame and the rear frame, the open space configured to allow a user to step through the open space between the front frame and the rear frame;

a seat support assembly mounted on the rear frame, the seat support assembly including, a track inclined at a permanently fixed angle wherein the angle is between about forty degrees and about sixty degrees relative to the surface, and a seat coupled to the track and being moveable along the track from a first position to a second position, the seat having a top surface and a geometry center coincident with the top surface that defines a vertical height between the geometry center and the reference plane, wherein positions of the geometry center and the reference plane define a first line that is swept forward approximately 60 degrees about the geometry center to define a first reference sector rotated about the geometry center;

first and second pedals coupled to the base frame for rotation about an axis and adapted to be propelled by the user's feet, the first and second pedals rotating along a closed circular path having four equal length sectors, wherein one of the four equal length sectors is a downward and backward sector, wherein a periphery of the first reference sector intersects the downward and backward sector at the first and the second positions of the seat along the track, and wherein a line that extends through the geometric center at the fixed angle of the track intersects the closed circular path;

a mast extending upwardly from the front frame, the mast including a lower portion and an upper portion;

a control console mounted on the upper portion of the mast; and a handle assembly mounted on the upper portion of the mast.

10. The stationary exercise bicycle of claim 9, wherein the handle assembly is directly above the closed circular path.

11. The stationary exercise bicycle of claim 9, wherein at least a portion of the control console is directly above the closed circular path.

12. The stationary exercise bicycle of claim 9, wherein the fixed angle is forty-five degrees.

13. The stationary exercise bicycle of claim 9, wherein the fixed angle is between about forty degrees and about fifty degrees.

14. The stationary exercise bicycle of claim 9, wherein the seat further includes a rear portion and a front portion, wherein the rear portion is wider than the front portion to support the user, and wherein the front portion is narrower than the rear portion to allow the user's thighs to move downward below the top surface of the seat.

15. The stationary bicycle of claim 9, further comprising a spring assembly configured to assist the seat in movement from the lowest position to the highest position.

* * * * *